US006315256B1

(12) United States Patent
Tolar

(10) Patent No.: US 6,315,256 B1
(45) Date of Patent: Nov. 13, 2001

(54) RIFLE/CAMERA SUPPORT APPARATUS FOR TREESTANDS

(76) Inventor: David D. Tolar, 210 Charity Rd., Homer, GA (US) 30547

( * ) Notice: Subject to any disclaimer, the term of this patent is extended or adjusted under 35 U.S.C. 154(b) by 0 days.

(21) Appl. No.: 09/433,393

(22) Filed: Nov. 3, 1999

Related U.S. Application Data

(63) Continuation-in-part of application No. 09/197,822, filed on Nov. 23, 1998.

(51) Int. Cl.[7] ..... A47B 96/06

(52) U.S. Cl. ..... 248/230.4; 248/231.5; 248/316.1; 42/94

(58) Field of Search ..... 248/230.4, 231.51, 248/316.1, 316.5, 286.5, 286.1, 122.1, 227.3, 214, 230.2, 230.1, 157.1, 50, 176.1, 309.1, 177.1; 42/94

(56) References Cited

U.S. PATENT DOCUMENTS

D. 411,280 * 6/1999 Van Ek et al. ..... D22/108
518,196 * 4/1894 Mohroff et al. ..... 248/230.4
3,027,895 * 4/1962 Williams ..... 248/230.4
5,377,657 * 1/1995 Foster et al. ..... 124/86
5,438,786 * 8/1995 Hilderbrand ..... 42/94
5,873,522 * 2/1999 Roberts ..... 239/1
5,930,931 * 8/1999 Watson ..... 42/94

FOREIGN PATENT DOCUMENTS

3600643 * 7/1987 (DE) ..... 248/187.1
583422 * 9/1933 (DE) ..... 248/230.4

* cited by examiner

*Primary Examiner*—Ramon O. Ramirez
*Assistant Examiner*—Kimberly Wood
(74) *Attorney, Agent, or Firm*—Kenneth L Tolar

(57) ABSTRACT

A rifle/camera support apparatus 10 for a safety bar 100 on conventional tree stands wherein the support apparatus 10 comprises a vertical support unit 11 rotatably disposed on a clamp unit 12 that is dimensioned to frictionally engage the periphery of the safety bar 100. The support unit 11 comprises an elongated generally cylindrical support member 20 having an upper end 21 provided with an enlarged recess 23 dimensioned to receive the barrel of a firearm. The enlarged recess is further provided with a central threaded aperture 24 which is dimensioned to receive a camera mount adapter 50.

6 Claims, 3 Drawing Sheets

RIFLE/CAMERA SUPPORT APPARATUS FOR TREESTANDS

CROSS REFERENCE TO RELATED APPLICATIONS

This is a Continuation-In-Part of application Ser. No. 09/197,822 filed on Nov. 23, 1998.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This is a Continuation-In-Part of application Ser. No. 09/197,822 filed on Nov. 23, 1998.

The present invention relates to the field of rifle and camera supports for outdoor use in general, and in particular to a convertible support apparatus for rifles and cameras that can quickly be attached to a tree stand.

2. Description of Related Art

As can be seen by reference to the following U.S. Pat. Nos. 3,022,898; 5,347,740; 5,723,808; and 5,740,625, the prior art is replete with myriad and diverse rifle and/or camera supports for outdoor usage.

While all of the aforementioned prior art constructions are more than adequate for the basic purpose and function for which they have been specifically designed, they are uniformly deficient with respect to their failure to provide a simple, efficient, and practical convertible rifle/camera support that is specifically designed for use with the current day more elaborate tree stand constructions.

As most bow and gun hunters are aware, a new class of luxury style treestand construction has recently come into the marketplace and been very favorably received by outdoor enthusiasts. While many of these newer style treestands employ a tubular safety bar that serves as a gun rest and may be either padded or unpadded, these safety bars not only do not provide lateral stability for a firearm, but they also do not have any provision for mounting a camera thereon.

As a consequence of the foregoing situation, there has existed a longstanding need among treestand users in particular, for a new and improved type of convertible camera/rifle support apparatus for treestands equipped with a tubular safety bar, and the provision of such a construction is a stated objective of the present invention.

BRIEF SUMMARY OF THE INVENTION

Briefly stated, the camera/rifle support apparatus for conventional treestands equipped with a tubular safety bar that forms the basis of the present invention comprises in general, a support unit and a quick release clamp unit wherein the support unit is rotatably disposed on top of the clamp unit, which in turn is releasably engageable with the tubular surround that is standard equipment on most newer conventional treestands.

As will be explained in greater detail further on in the specification, the camera/rifle support apparatus can be quickly and easily attached and detached at any selected location on the conventional tubular surround to accommodate both right and left handed shooters. The rotatable relationship between the support unit and the clamp unit allows the barrel of the gun to traverse through a limited arc of rotation at the selected location to track the movement of a game animal prior to the hunter taking a shot.

In addition, the clamp unit is further provided with a quick release mechanism that allows the support apparatus to be quickly, easily, and most importantly quietly shifted from one location on the tubular support to another location in the event that the game animal appears from an unexpected direction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
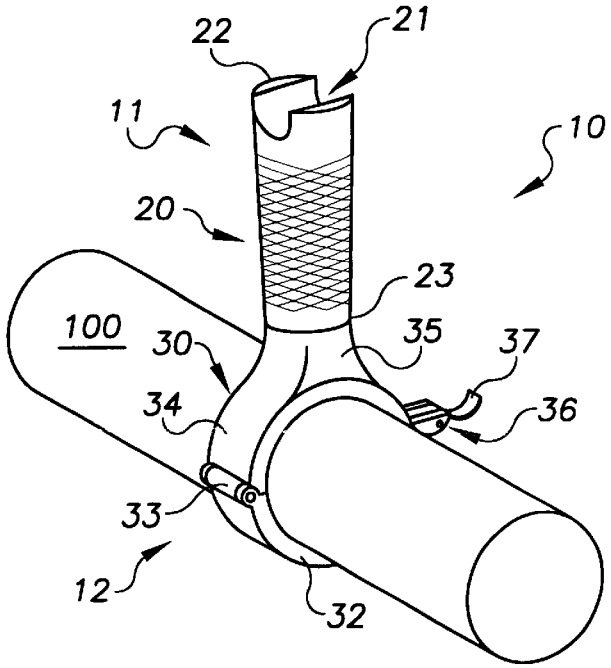
FIG. 1 is a perspective view of the camera/rifle support apparatus installed on a portion of a conventional tubular surround for treestands.

As can be seen by reference to the drawings, and in particularly to FIG. 1, the convertible camera/rifle support apparatus that forms the basis of the present invention is designated generally by the reference number 10. The support apparatus 10 comprises in general, a vertical support unit 11, and a clamp unit 12. These units will now be described in seriatim fashion.

Figure 2:
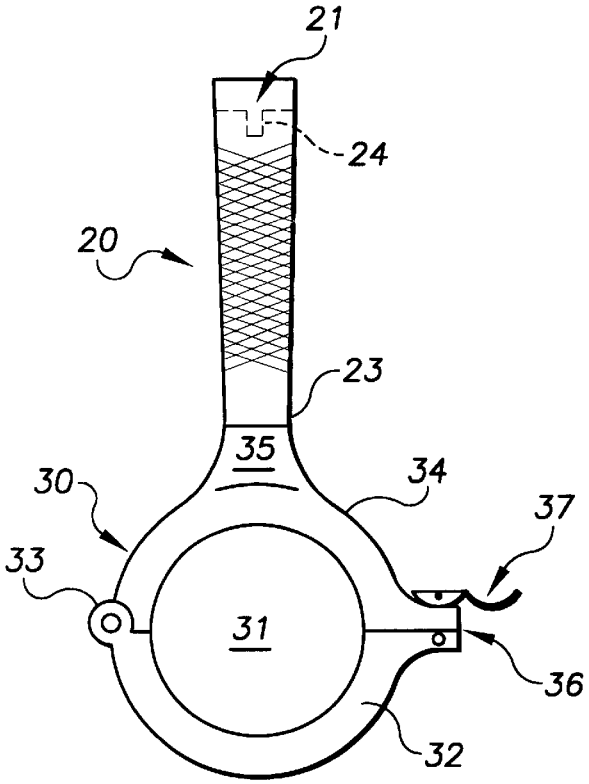
FIG. 2 is a side plan view of the support apparatus.
Figure 3:
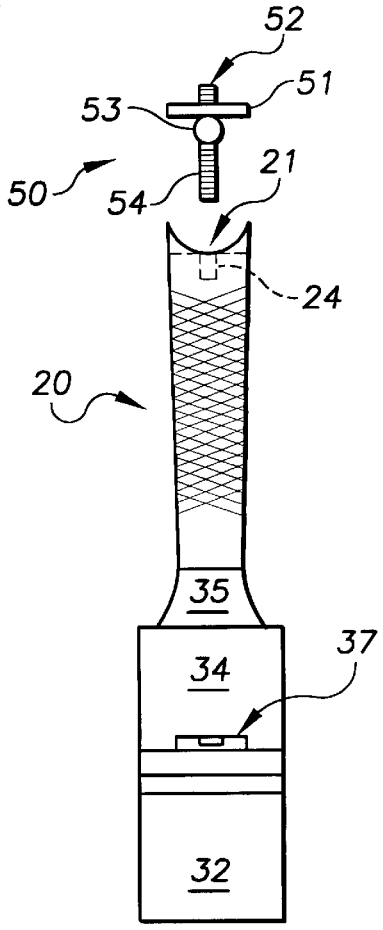
FIG. 3 is a front plan view of the support apparatus.

As shown in FIGS. 1 through 3, the vertical support unit 11 comprises a generally elongated cylindrical vertical support member 20 having an enlarged arcuate recess 21 formed in the upper end 22. The lower end 23 of the support member 20 is rotatably disposed in the upper end of the clamp unit 12 as will be explained presently.

In addition, as shown in FIGS. 2 and 3, the enlarged recess 21 is further provided with a threaded central aperture 24 which is adapted to receive a camera mount adapter 50 that will be described in greater detail further on in the specification.

As can also be seen by reference to FIGS. 1 through 3, the clamp unit 12 comprises a circular clamp member 30 having an enlarged central opening 31 that is dimensioned to receive and frictionally engage the periphery of a conventional safety bar 100 that has become a standard feature on many of the higher priced treestands currently on the market.

In addition, the clamp member 30 includes a generally C-shaped lower clamp jaw 32 that is hingedly connected as at 33 to a generally C-shaped upper clamp jaw 34. The apex of the upper clamp jaw 34 is provided with a vertical stem element 35 that is adapted to rotatably receive and support the lower end 23 of the vertical support member 20 in a well recognized fashion.

Still referring to FIGS. 1 through 3, it can be seen that the free ends of the upper 34 and lower 32 clamp jaws are provided with a cam lock mechanism 36 having a quick release latch 37. The clamp jaws 32, 34 can be quickly and quietly disengaged to relocate the support apparatus 10 on another portion of the safety bar 100.

Turning now to FIG. 3, it can be seen that the camera mount adapter 50 comprises a mounting plate member 51 having an upwardly projecting screw element 52 dimensioned to be received in a complementary threaded mounting aperture provided on the bottom of most cameras and video equipment. The bottom of the mounting plate member 51 is provided with a universal swiveling coupler element 53 having a downwardly depending threaded stem element 54 which is dimensioned to be received in the threaded aperture 24 in the vertical support member 20 such that one apparatus 10 can be employed as a rifle rest and another apparatus 10 can be employed as a camera rest.

Figure 4:
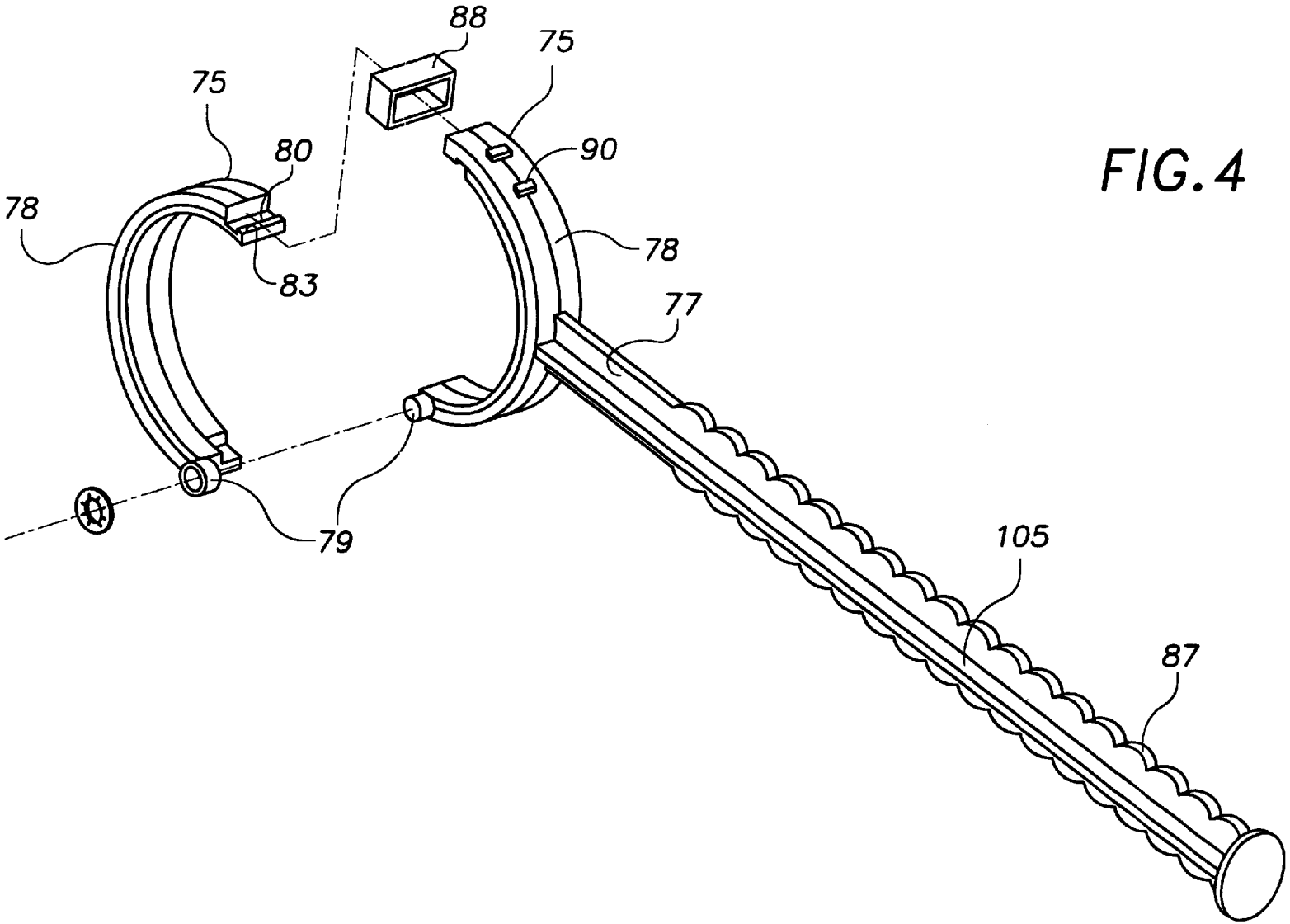
FIG. 4 is a perspective, exploded view of a second embodiment.
Figure 5:
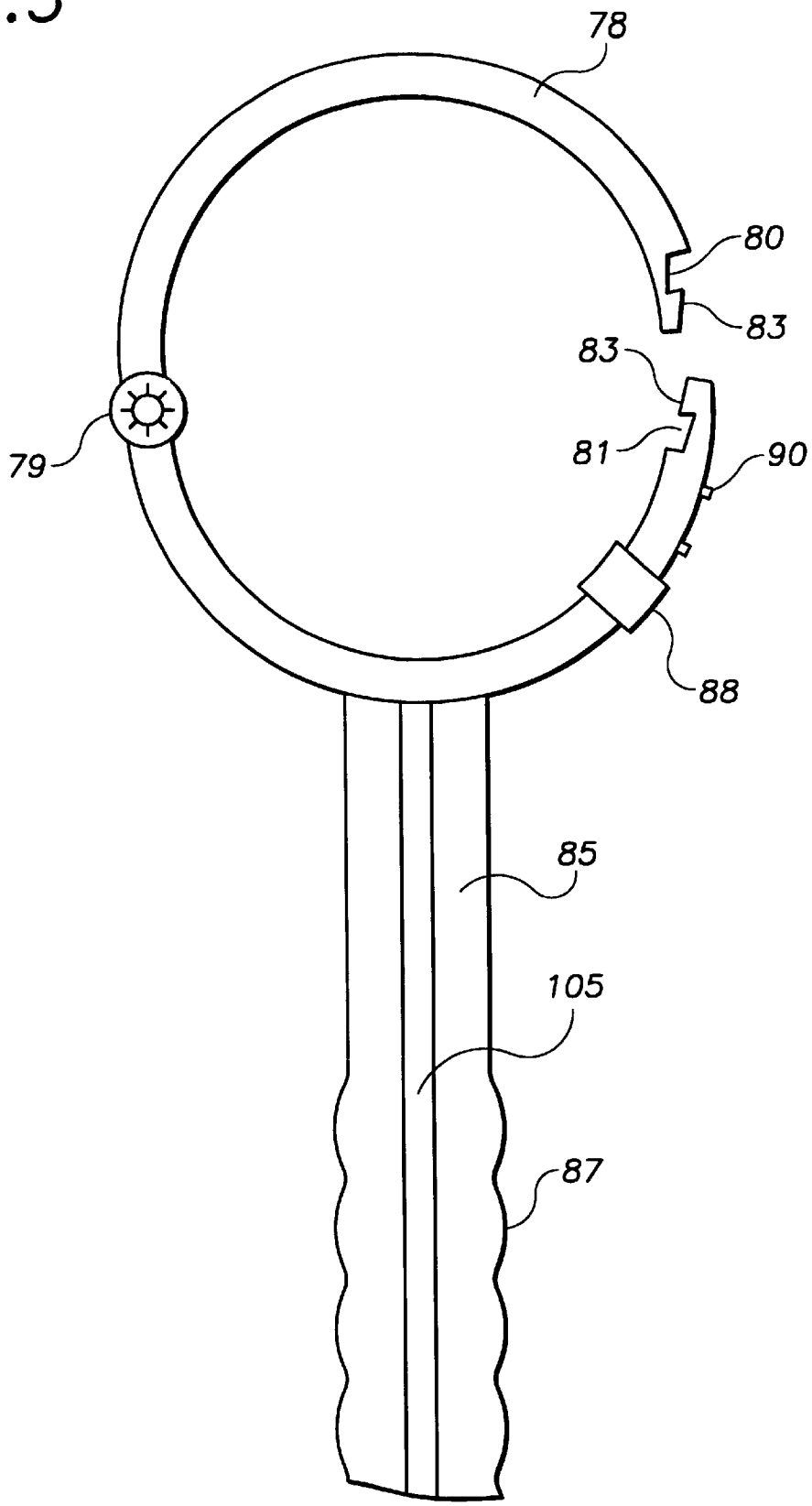
FIG. 5 depicts a front plan, partial cut away view of the second embodiment.

Now referring to FIGS. 4 and 5, a second embodiment is disclosed. The second embodiment includes a clamp unit 75 similar to that of the first embodiment and an elongated stem portion 77 depending therefrom. The clamp unit includes a pair of substantially C-shaped. jaws 78 each having a pair of terminal ends. A first set 79 of terminal ends are hingedly joined with the other terminal edges being free allowing the clamp member to be wrapped about a tree stand safety bar 100.

The free ends can be removably joined with a latch means to secure the clamp unit about the bar 100. The latch means includes a notch 80 on an outwardly facing side of a first jaw, proximal the free end, while the free end of the other section includes a similar notch 81 on an inwardly facing side. Adjacent each notch is a tongue 83 dimensioned and configured to seat within the notch on the opposing jaw to join the two jaws together. A sleeve 88 is slidably mounted on one of the jaws which may be slid over the joined free ends to further secure the connection. The jaw also includes a pair of spaced protrusions 90 thereon between which the sleeve is retained when not in use. The above described latch means may also be used with the first embodiment in place of the cam lock mechanism.

The stem portion according to the second embodiment includes a transverse portion 105 with a pair of opposing longitudinal, outwardly extending flanges 85 perpendicularly extending therefrom. The terminal edge of each flange includes a plurality of ridges 87 disposed along substantially the entire length thereof to assist a user in grasping the device.

To use the device, the clamp unit is secured about the tree stand safety bar with the stem upwardly extending therefrom. The stem portion is grasped with a user's hand and the barrel or barrel stock is simultaneously rested against one of the ridged flanges. The device assists a shooter in stabilizing the gun barrel to provide a more accurate shot.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. In combination with a tree stand safety bar, an interchangeable camera and rifle support apparatus wherein the apparatus comprises:

a releaseable clamp dimensioned and configured to surround and frictionally engage said safety bar;

wherein said clamp assembly includes an upper clamp jaw and a lower clamp jay, each jaw having a pair of terminal ends with the first ends of said jaws hingedly joined and the second edges being free, each free end having a mating latch means thereon for securing said clamp about said tree stand safety bar;

a vertical support member upwardly extending from said clamp and rotatably coupled therewith, said support member having an upper end with an arcuate recess thereon for receiving a gun barrel stock, said recess having a threaded bore thereon;

a threaded stem threadedly received within said threaded bore;

a mounting plate member swivelly connected to said threaded stem, said plate having an upwardly projecting screw element for threadedly engaging a threaded bore on a camera to secure said camera to said vertical support member.

2. An apparatus according to claim 1 wherein said clamp includes an upper clamp jaw and a lower clamp jaw, each jaw having a pair of terminal ends with the first ends of said jaws hingedly joined and the second ends being free, each free end having a mating latch means thereon for securing said clamp about said support member.

3. An apparatus according to claim 2 wherein said latch means comprises:

a tongue disposed adjacent the free end of each jaw, each tongue having a groove immediately adjacent thereto, wherein the tongue on each jaw is inserted into the groove on the other jaw to secure said jaws together.

4. A firearm support comprising:

a clamp assembly for securing to a tree stand safety bar;

an elongated stem extending from said clamp assembly, said stem including a pair of elongated, outwardly extending flanges each terminating at a longitudinal edge, each edge having a plurality of ridges thereon to assist a user in grasping the stem and to stabilize a firearm barrel when placed thereagainst.

5. A firearm support according to claim 1 wherein said latch means comprises:

a tongue disposed adjacent the free end of each jaw, each tongue having a groove immediately adjacent thereto, wherein the tongue on each jaw is inserted into the groove on the other jaw to secure said jaws together.

6. The firearm support according to claim 5 further comprising a sleeve slidably mounted on one of said jaws which is slid over said joined free ends to further secure said clamp about said support member.

* * * * *